US006981358B2

(12) United States Patent
Bellucci et al.

(10) Patent No.: US 6,981,358 B2
(45) Date of Patent: Jan. 3, 2006

(54) REHEAT COMBUSTION SYSTEM FOR A GAS TURBINE

(75) Inventors: Valter Bellucci, Fislisbach (CH); Peter Flohr, Birmenstorf (CH); Christian Oliver Paschereit, Baden (CH); Bruno Schuermans, Basel (CH); Daniele Tabacco, Rom (IT)

(73) Assignee: ALSTOM Technology Ltd., Baden (CH)

( * ) Notice: Subject to any disclaimer, the term of this patent is extended or adjusted under 35 U.S.C. 154(b) by 208 days.

(21) Appl. No.: 10/460,363

(22) Filed: Jun. 13, 2003

(65) Prior Publication Data

US 2005/0229581 A1 Oct. 20, 2005

(30) Foreign Application Priority Data

Jun. 26, 2002 (GB) ..... 0214783

(51) Int. Cl.
*F02C 1/06* (2006.01)
*F02C 6/00* (2006.01)

(52) U.S. Cl. ..... 60/39.17; 60/725; 60/737; 60/754

(58) Field of Classification Search ..... 60/722, 60/725, 726, 728, 737, 738, 752–755, 757, 60/39.17

See application file for complete search history.

(56) References Cited

U.S. PATENT DOCUMENTS 3,848,697 A 11/1974 Jannot et al.
4,199,936 A * 4/1980 Cowan et al. ..... 60/226.1
5,660,044 A * 8/1997 Bonciani et al. ..... 60/737
5,765,376 A * 6/1998 Zarzalis et al. ..... 60/748
5,784,876 A * 7/1998 Alkabie ..... 60/776
5,941,076 A * 8/1999 Sandelis ..... 60/752
6,351,947 B1 * 3/2002 Keller et al. ..... 60/725
6,609,376 B2 * 8/2003 Rokke ..... 60/748
6,640,544 B2 * 11/2003 Suenaga et al. ..... 60/725
6,732,527 B2 * 5/2004 Freeman et al. ..... 60/737

FOREIGN PATENT DOCUMENTS

EP 0 971 172 A1 1/2000

OTHER PUBLICATIONS

Search Report in GB 0214783.3 (Aug. 31, 2002).

* cited by examiner

*Primary Examiner*—William H. Rodriguez
(74) *Attorney, Agent, or Firm*—Cermak & Kenealy, LLP; Adam J. Cermak

(57) ABSTRACT

A reheat combustion system for a gas turbine comprises a mixing tube adapted to be fed by products of a primary combustion zone of the gas turbine and by fuel injected by a lance; a combustion chamber fed by the said mixing tube; and at least one perforated acoustic screen. The or each said acoustic screen is provided inside the mixing tube or the combustion chamber, at a position where it faces, but is spaced from, a perforated wall thereof. In use, the perforated wall experiences impingement cooling as it admits air into the combustion system for onward passage through the perforations of the said acoustic screen, and the acoustic screen damps acoustic pulsations in the mixing tube and combustion chamber.

6 Claims, 5 Drawing Sheets

REHEAT COMBUSTION SYSTEM FOR A GAS TURBINE

BACKGROUND OF THE INVENTION

1. Field of the Invention

This invention relates to a reheat combustion system for a gas turbine. In particular, the invention relates to such a system comprising acoustic damping.

In modern industrial gas turbines operating with pre-mix combustion flames, it is important to suppress pressure pulsations in order to maintain the quality of the combustion process and preserve structural integrity of the turbine. To date, acoustic damping techniques have been employed in order to dissipate acoustic power and thereby reduce the pressure pulsations.

2. Brief Description of Related Art

In conventional gas turbines (having only one combustion zone) it is known to damp low frequency pulsations using Helmholtz resonators. The simplest design for a Helmholtz resonator comprises a cavity, with a neck through which the fluid inside the resonator communicates with an enclosure that the resonator is applied to. At its resonance frequency, the Helmholtz resonator is able to produce a small acoustic pressure on the mouth of its neck. When the resonance frequency of the resonator coincides with an eigenfrequency of the enclosure with a mode having a high-pressure value where the resonator neck is located, then the resonator is able to damp the acoustic mode.

The advantage of a Helmholtz resonator is that the area of the neck mouth may be considerably smaller than the boundary of the enclosure. On the other hand, Helmholtz resonators may damp only single modes, with a damping efficiency proportional to the volume of the resonator cavity. Consequently, Helmholtz resonators are normally confined for use in the low frequency range, where the frequency shift between acoustic modes is relatively large (i.e. pressure peaks are well separated) and the resonator volume is also relatively large.

As an alternative to Helmholtz resonators, it is known to use quarter wavelength dampers. In such dampers, the cavity and neck of a Helmholtz resonator are replaced by a single tube.

In a gas turbine comprising a reheat combustion system, a secondary combustion zone is realised by injecting fuel into a high velocity gas stream formed by the products of the primary combustion zone. Consequently, combustion occurs without the need for flame stabilisation and high-frequency pulsations are generated. In such a case, classical Helmholtz resonators are not optimal for the frequency range in question.

To damp high-frequency noise generated in rocket engines and aircraft engines, acoustic liners are usually employed. A liner typically consists of a perforated screen which lines the engine ducts (for example the fan ducts of a turbo fan engine). An inperforated screen is provided behind the perforated screen and a honeycomb core is generally located between the two screens.

The goal of the liner is to provide a wall which does not fully reflect acoustically and is able to damp pulsations across a broad range of frequencies. The acoustic behaviour of the liner is defined by means of its impedance $Z=R+iX$. That is to say, the ratio between acoustic pressure and velocity of the fluid normal to the wall, both being defined in the frequency domain. The real part R of the impedance is the resistance, determined by dissipative processes occurring in the voids of the liner. The main dissipative effect is the conversion of acoustic energy into a shedding of vorticity, generated at the rims of the perforations in the screen, convected downstream and finally dissipated into heat by turbulence. The imaginary part X of the impedance is the reactance, which represents the inertia of the fluid fluctuating in the perforations and in the cavity between the two screens under the effect of the acoustic field.

To damp high order modes (i.e. for high-frequency applications), the liners are typically designed to have a resistance R close to $\rho c$ (wherein $\rho$ is the fluid density and c the speed of sound in the fluid) and reactance X close to 0. It should be understood that the conditions $R=\rho c$ and $X=0$ correspond to the anechoic condition (that is to say the full absorption of acoustic energy of a normally incident plane wave).

Converse to for the situation with a Helmholtz damper, the efficiency of the liner is strongly related to the portion of the surface that the liner covers. Consequently, different liner designs have been proposed, in which the damped frequency band was extended by use of a multi-layer liners or by a non uniform distribution of honeycomb cells between the two screens. However, the walls of the burner and combustion chamber must be cooled by means of cold air coming from the compressor and the acoustic liners do not readily facilitate this.

SUMMARY OF THE INVENTION

The present invention sets out to provide a means for damping high-frequency pulsations for a gas turbine reheat system, whilst providing good cooling characteristics.

Accordingly, the invention provides a reheat combustion system for a gas turbine, the said system comprising:

a mixing tube adapted to be fed by products of a primary combustion zone of the gas turbine and by fuel injected by a lance;

a combustion chamber fed by the said mixing tube; and at least one perforated acoustic screen;

wherein the or each said acoustic screen is provided inside the mixing tube or the said combustion chamber, at a position where it faces, but is spaced from, a perforated wall thereof; such that, in use, the said perforated wall experiences impingement cooling as it admits air into the combustion system for onward passage through the perforations of the said acoustic screen, and the acoustic screen damps acoustic pulsations in the said mixing tube and combustion chamber.

A front panel of the said combustion chamber may define a said perforated wall and the said system may be provided with a said acoustic screen facing the said front panel. In such a case, the combustion chamber and mixing tube may each be generally cylindrical and the two be mutually coaxial, the mixing tube extending partially into the said combustion chamber and being surrounded, in an end region thereof, by the front panel-facing acoustic screen; the arrangement being such that the front panel-facing acoustic screen, the front panel, the mixing tube and a cylindrical wall of the said combustion chamber together define a substantially annular cavity therebetween.

Alternatively, a front panel of the said combustion chamber may define a said acoustic screen and the said system may be provided with a perforated wall facing the said front panel.

A wall of the said mixing tube may define a said perforated wall and the said system may be provided with an acoustic screen facing the said mixing tube.

A wall of the said mixing tube may define a said acoustic screen and the said system may be provided with a perforated wall facing the said mixing tube.

An outer wall of the said combustion chamber may define a said acoustic screen and the said system may be provided with a perforated wall facing the said outer wall of the said combustion chamber.

An outer wall of the said combustion chamber may define a said perforated wall and the said system may be provided with an acoustic screen facing the said outer wall of the said combustion chamber.

A further aspect of the invention provides gas turbine comprising a reheat combustion as set out above.

Accordingly, embodiments of the invention are able to damp high frequency pulsations. The acoustic screens provided by the invention have some similarity to liners, but provide substantial advantages in the reheat combustion system.

In common with liners, the acoustic screens of the invention seek to provide an anechoic condition in order to absorb all the acoustic energy of a normally incident plane wave. However, contrary to a liner, the invention enables a "bias flow" to be maintained, which allows cooling by means of cold air coming from the compressor.

In a liner, the resistance R is non linear, because it depends on the convection and dissipation of acoustically produced vorticity by means of the acoustic field itself. The tuning of R is complicated, because the resistance depends on the acoustic pressure in front of the wall (which is a function of the applied R). When a bias flow is proceeding through the screen perforations, there is a linear contribution to R from the bias flow convection of vorticity. The linear effect is prevalent on the non linear one, when the bias velocity is greater than the acoustic velocity in the perforation. In this case, R depends on frequency only and can be tuned by acting on the bias flow velocity and the screen porosity, independently of the acoustic field.

The acoustic screen forming part of the invention enables impingement cooling to take place by use of the cavity between the perforated wall and the acoustic screen (i.e. for tuning the reactance X to 0 in correspondence to the frequency which is to be damped). It is additionally the case that the pressure drop may be split between the perforated wall and the acoustic screen. This is significant, because if the pressure drop is large, both jet velocity and dissipation are also large, giving the acoustic resistance of an acoustically full reflecting wall (i.e. with no damping).

BRIEF DESCRIPTION OF THE DRAWING FIGURES

Embodiments of the invention will now be described by way of example with reference to the accompanying drawings in which.

Figure 4A:
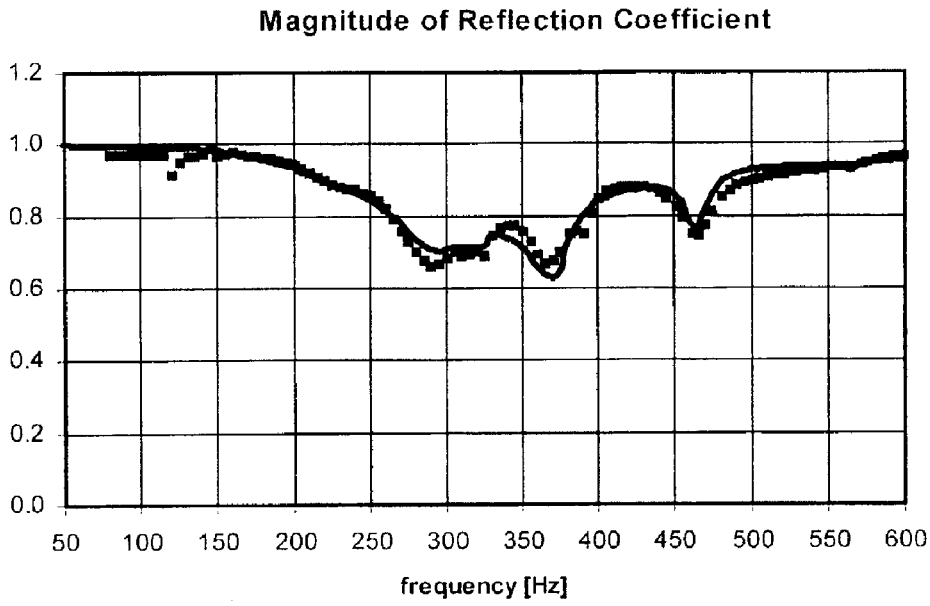
Figure 4B:
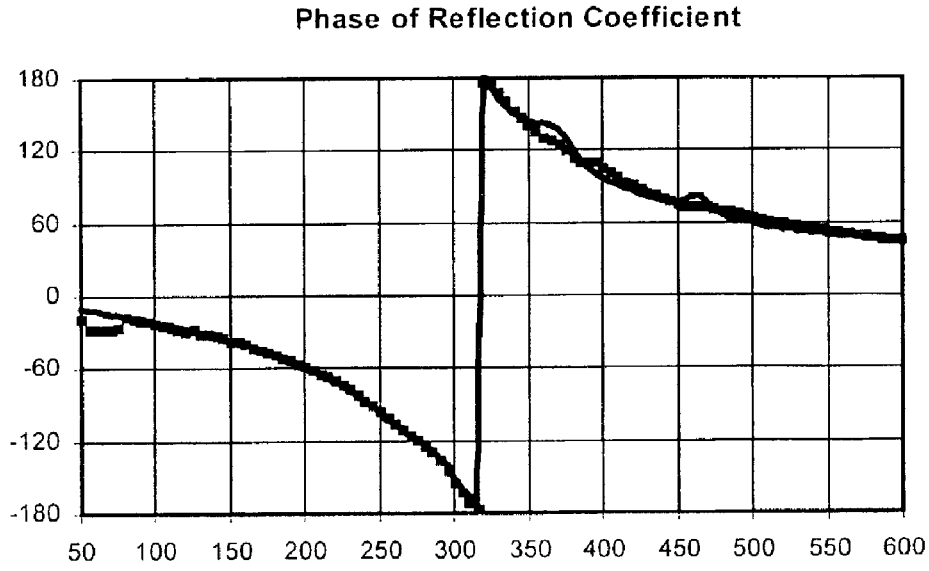
Figure 5A:
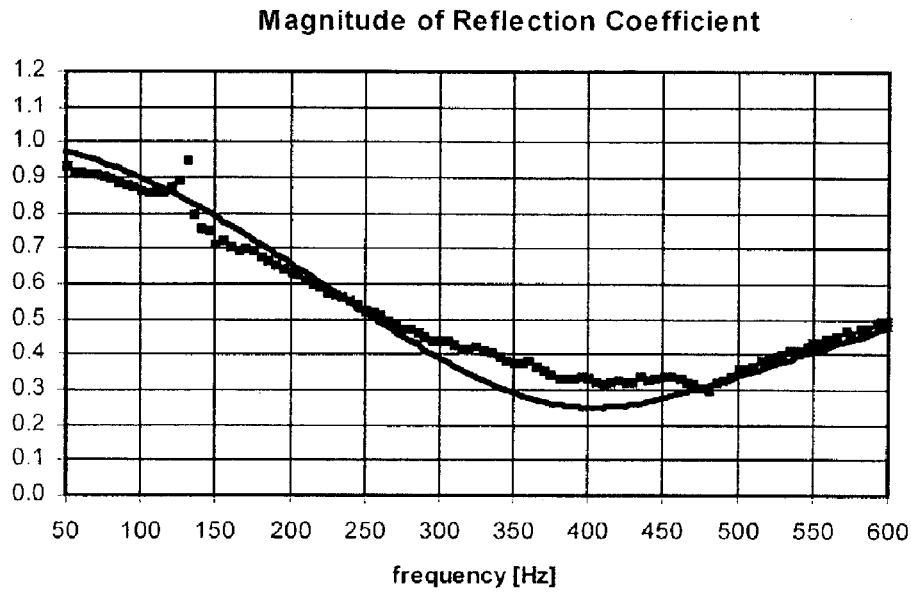
Figure 5B:
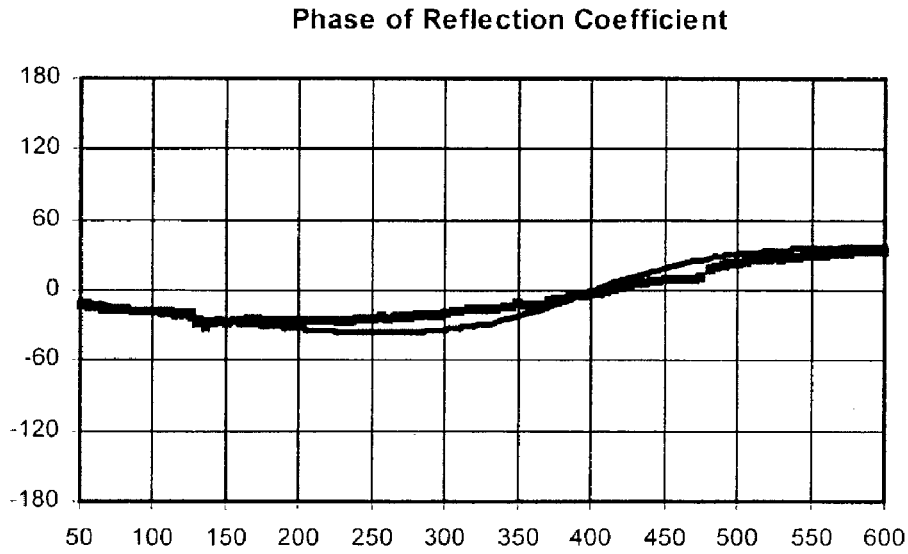

FIG. 4*a* shows the magnitude of the acoustic screen reflection coefficient for a plate with velocity 2.5% and no bias flow velocity through the holes;

FIG. 4*b* shows the phase of the acoustic screen reflection coefficient for a plate with velocity 2.5% and no bias flow velocity through the holes;

FIG. 5*a* shows the magnitude of the acoustic screen reflection coefficient for a plate with velocity 2.5% and 8 m/s bias flow velocity through the holes; and FIG. 5*b* shows the phase of the acoustic screen reflection coefficient for a plate with velocity 2.5% and 8 m/s bias flow velocity through the holes.

DETAILED DESCRIPTION OF EMBODIMENTS OF THE INVENTION

The figures are schematic and only the elements essential for the understanding of the invention are shown. In particular, the figures do not show the high and low pressure turbines (located upstream of burner and downstream of the combustion chamber, respectively), the primary combustion system or the compressor. These components would be well-understood to the skilled addressee and may be conventional.

Figure 1:
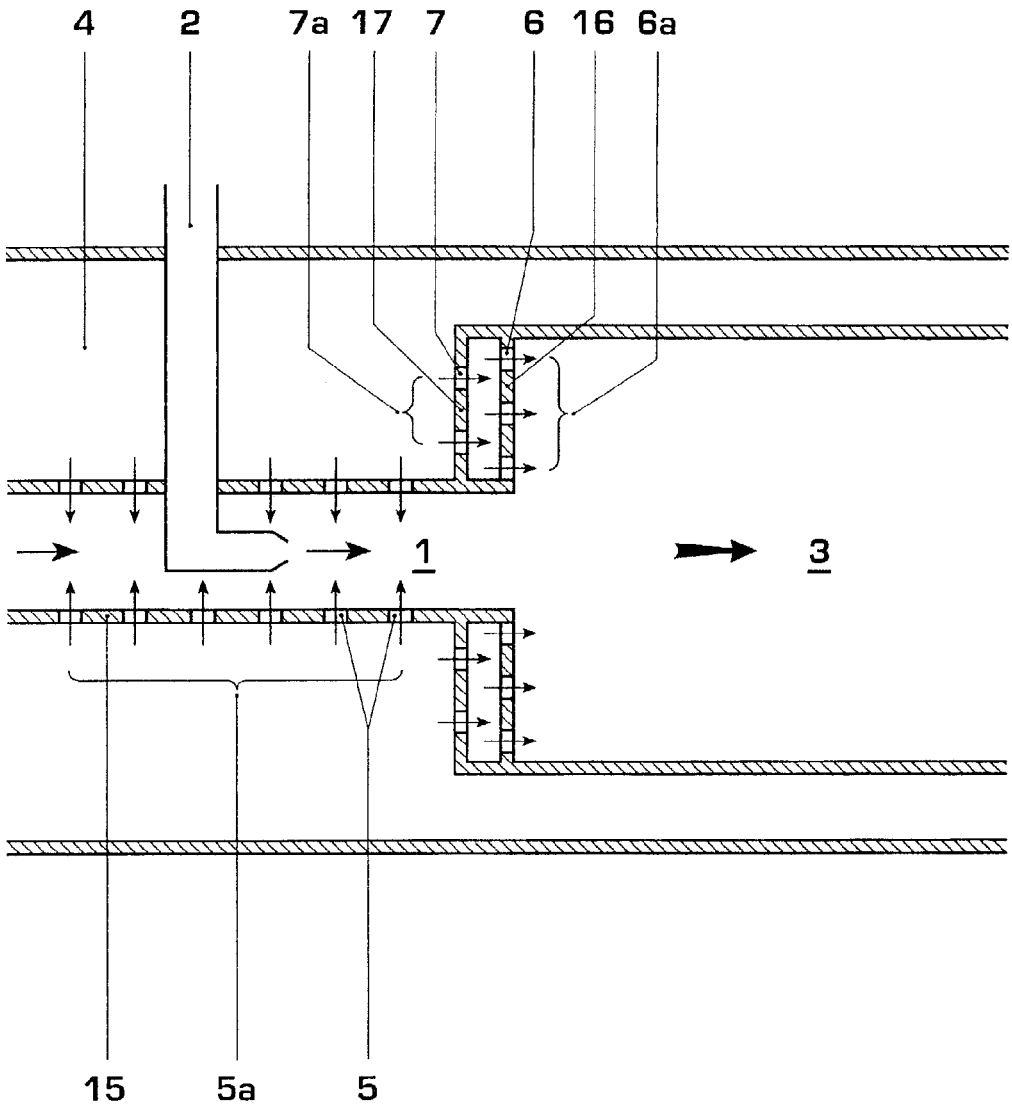
FIG. 1 shows a re-heat combustion system comprising impingement cooling and an acoustic screen applied to the front panel of the burner, in accordance with the invention.

FIG. 1 shows a burner 1, which is fed with a pre-mixed stream of reactants obtained by mixing the hot oxygen stream (i.e. the products of the primary combustion) entering the burner 1 with fuel injected by lance 2.

The mixture enters the combustion chamber 3, where combustion occurs. The walls of the burner 1 are perforated and are cooled by air flowing from the plenum 4. In this regard, the burner mixing tube 15 comprises rows of perforations 5, which admit air flows 5*a*. These serve to cool the mixing tube 15 by means of effusion. The axially facing front panel 17 of the combustion chamber 3 is provided with apertures 7*a* which admit an air flow 7, which cools the front panel 17 by impingement cooling.

Inside the combustion chamber 3, in a region axially adjacent the burner front panel 17, there is provided an annular screen 16, which is parallel to the burner front panel 17 and separated by a short axial distance. The mixing tube 15 extends into the combustion chamber 3, so as to terminate at the same axial location as the acoustic screen 16, thereby providing an annular cavity between the burner front panel 17 and the screen 16.

The acoustic screen 16 is provided with a further series of apertures 6 and these admit the flow 7*a* into the combustion chamber 3 as flow 6*a*.

The screen porosity is such that the flow 6*a* discharged into the combustion chamber 3 provides acoustic damping by having a bias flow velocity which is able to realise the condition $R=\rho c$. The annular cavity is configured such that the reactance is 0 or close to 0.

Figure 2:
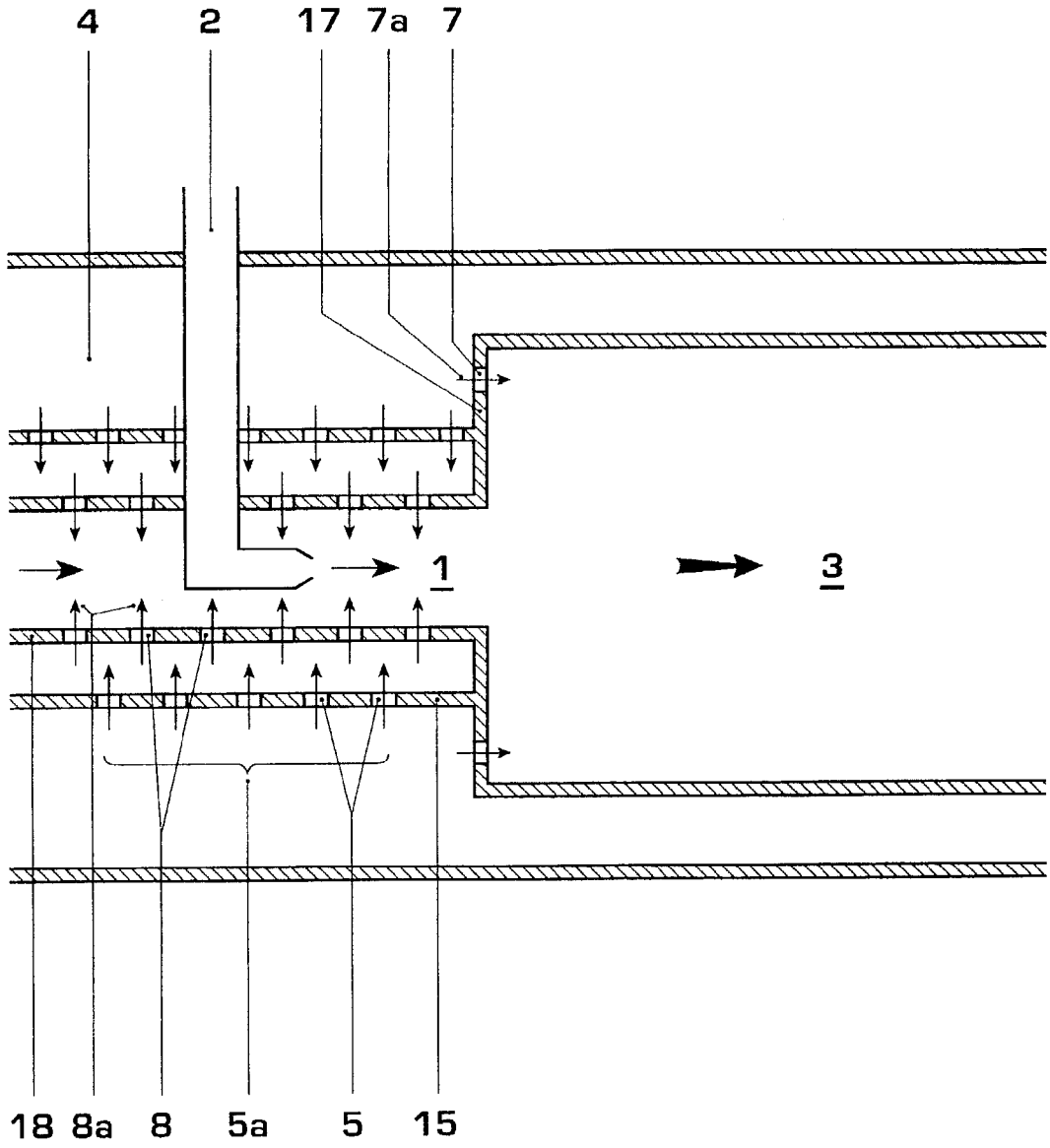
FIG. 2 shows a re-heat combustion system with impingement cooling and an acoustic screen applied to the burner mixing tube, in accordance with the invention.

Acoustic screens may alternatively or additionally be provided in other places on the burner 1. For example, FIG. 2 shows a further embodiment, in which the mixing tube 15 is provided with a cylindrical, co-axial screen 18, provided with a series of perforations 8. The fluid flow 5 from the plenum 4 provides impingement cooling on the mixing tube 15 and, after passing through the cylindrical cavity formed between the screen 18 and the mixing tube 15, it passes into the core of the mixing tube as flow 8*a* via perforations 8, so as to cause damping of the acoustic waves travelling in the burner 1. In this embodiment, the flow 7 through the front panel of the combustion chamber 3 is used for effusion cooling.

Figure 3:
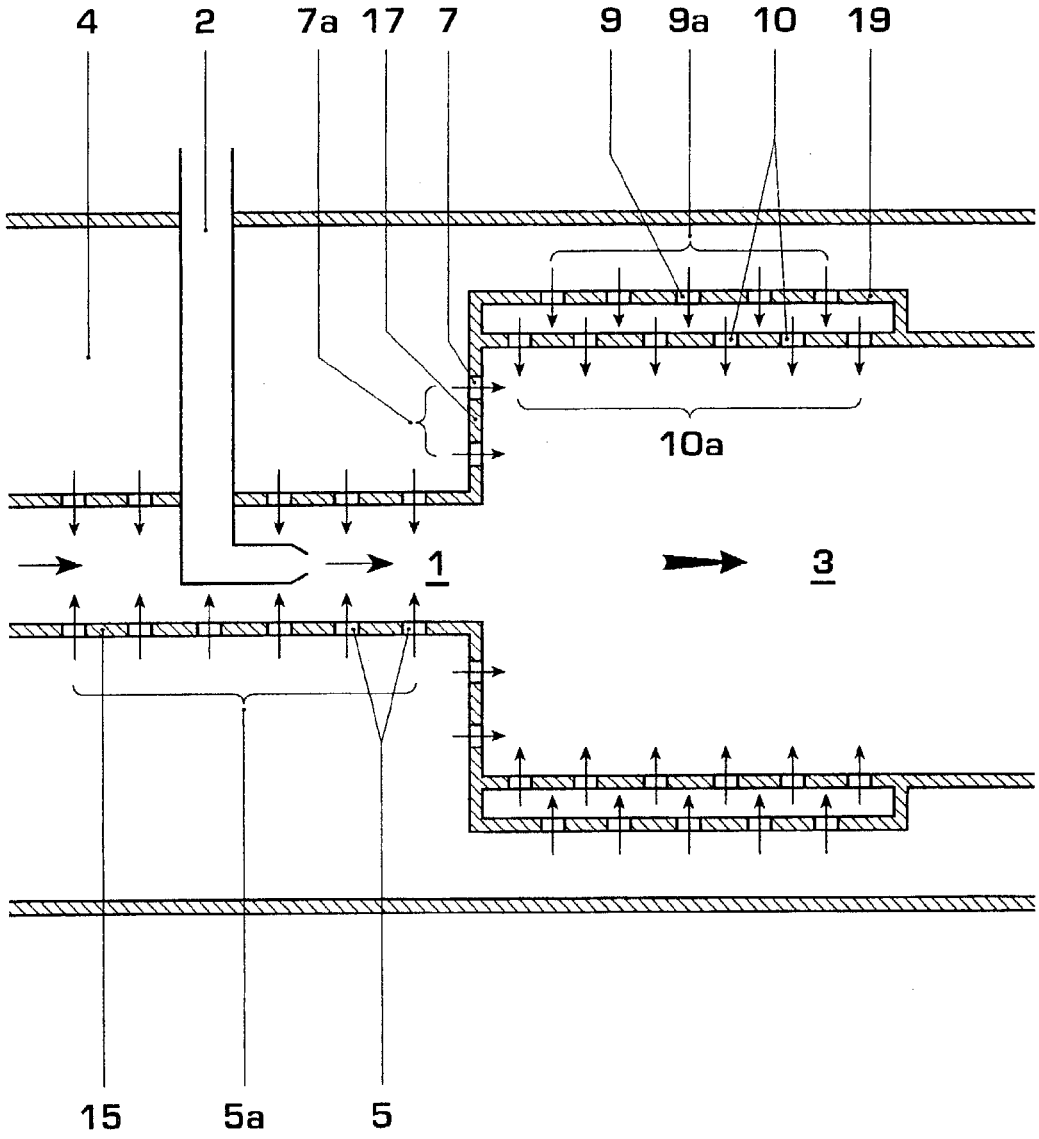
FIG. 3 shows a re-heat combustion system with impingement cooling and an acoustic screen applied to the combustion chamber liner, in accordance with the invention.

FIG. 3 shows a further embodiment, in which flows 5*a* and 6*a* through the mixing tube 15 and burner front panel 16 respectively provide effusion cooling. In this case, the wall of the combustion chamber 3 is perforations by apertures 10 and surrounded by a cylindrical, co-axial jacket 1*a* with closed end walls, so as to define a cylindrical cavity around the outside of the wall of the combustion chamber 3. The annular jacket 19 is perforated with perforations 9.

The effect of this arrangement is that fluid can enter from the plenum 4 via the perforations 9, as flow 9*a*. This flow 9*a* causes impingement cooling. Fluid is then admitted into the combustion chamber 3 via the perforations 10 in the wall of the chambers in order to effect acoustic damping. The effect is therefore that of an acoustic screen, as in the previous embodiments.

Although each of the foregoing embodiments might be considered to have the acoustic screen either added to the inside or the outside of the conventional burner 1, it is, in practice, largely irrelevant which of these is adopted. The significant thing is that there is a dual-layer structure with a cavity in between.

The screens have been designed using numerical modelling and FIGS. 4 and 5 show a comparison between numerical prediction and experimental results for embodiments of perforated screens. The results show magnitude and phase of the reflection coefficient $r=(Z+\rho c)/(Z-\rho c)$. FIGS. 4 and 5 illustrate the reflection coefficient for the same screen, without and with bias flow (and therefore non linear and linear damping) respectively. The bias flow, besides allowing the tuning of the resonance frequency, leads to a greater acoustic damping.

The magnitude plot indicates the maximum absorption for the resonance frequency, which is characterised by a typical phase jump. Both magnitude and phase show a good agreement between prediction and experiment, thereby showing the effectiveness of the embodiments.

Many further variations and modifications will suggest themselves to those versed in the art upon making reference to the foregoing illustrative embodiments, which are given by way of example only, and which are not intended to limit the scope of the invention, that being determined by the appended claims.

What is claimed is:

1. A reheat combustion system for a gas turbine, the system comprising:

a mixing tube adapted to be fed by products of a primary combustion zone of the gas turbine and by fuel injected by a lance;

a combustion chamber fed by the mixing tube, at least one of the mixing tube and the combustion chamber having a perforated wall; and at least one perforated acoustic screen;

wherein the at least one acoustic screen is provided inside the mixing tube or the combustion chamber, at a position where it faces, but is spaced from, the perforated wall thereof; such that, in use, the perforated wall experiences impingement cooling as it admits air into the combustion system for onward passage through the perforations of the acoustic screen, and the acoustic screen damps acoustic pulsations in the mixing tube and combustion chamber; and wherein the mixing tube includes a wall that defines the perforated wall and one of the at least one acoustic screen faces the mixing tube.

2. A gas turbine comprising a reheat combustion system according to claim 1.

3. A reheat combustion system for a gas turbine, the system comprising:

a mixing tube adapted to be fed by products of a primary combustion zone of the gas turbine and by fuel injected by a lance;

a combustion chamber fed by the mixing tube, at least one of the mixing tube and the combustion chamber having perforated wall; and at least one perforated acoustic screen;

wherein the at least one acoustic screen is provided inside the mixing tube or the combustion chamber, at a position where it faces, but is spaced from, the perforated wall thereof; such that, in use, the perforated wall experiences impingement cooling as it admits air into the combustion system for onward passage through the perforations of the acoustic screen, and the acoustic screen damps acoustic pulsations in the mixing tube and combustion chamber; and wherein the mixing tube includes a wall that defines one of the at least one acoustic screen and the perforated wall faces the mixing tube.

4. A gas turbine comprising a reheat combustion system according to claim 3.

5. A reheat combustion system for a gas turbine, the system comprising:

a mixing tube adapted to be fed by products of a primary combustion zone of the gas turbine and by fuel injected by a lance;

a combustion chamber fed by the mixing tube, at least one of the mixing tube and the combustion chamber having a perforated wall; and at least one perforated acoustic screen;

wherein the at least one acoustic screen is provided inside the mixing tube or the combustion chamber, at a position where it faces, but is spaced from, the perforated wall thereof; such that, in use, the perforated wall experiences impingement cooling as it admits air into the combustion system for onward passage through the perforations of the acoustic screen, and the acoustic screen damps acoustic pulsations in the mixing tube and combustion chamber; and wherein the combustion chamber comprises an outer wall which defines one of the at least one acoustic screen and the perforated wall faces the outer wall of the combustion chamber.

6. A gas turbine comprising a reheat combustion system according to claim 5.

* * * * *